US009395691B2

(12) United States Patent
Fleury et al.

(10) Patent No.: US 9,395,691 B2
(45) Date of Patent: Jul. 19, 2016

(54) SPRING FOR CLOCK MOVEMENT

(71) Applicant: ROLEX SA, Geneva (CH)

(72) Inventors: Christian Fleury, Challex (FR); Blaise Fracheboud, Plan-les-Ouates (CH)

(73) Assignee: ROLEX SA, Geneva (CH)

( * ) Notice: Subject to any disclaimer, the term of this patent is extended or adjusted under 35 U.S.C. 154(b) by 139 days.

(21) Appl. No.: 14/368,745

(22) PCT Filed: Dec. 26, 2012

(86) PCT No.: PCT/EP2012/076911

§ 371 (c)(1),
(2) Date: Jun. 25, 2014

(87) PCT Pub. No.: WO2013/102598

PCT Pub. Date: Jul. 11, 2013

(65) Prior Publication Data

US 2014/0362670 A1 Dec. 11, 2014

(30) Foreign Application Priority Data

Dec. 27, 2011 (EP) ..... 11405378

(51) Int. Cl.

| | |
|---|---|
| ***G04B 11/02*** | (2006.01) |
| ***G04B 11/00*** | (2006.01) |
| ***G04B 19/25*** | (2006.01) |
| ***G04B 19/253*** | (2006.01) |
| ***G05G 5/06*** | (2006.01) |

(52) U.S. Cl.

CPC ..... *G04B 11/028* (2013.01); *G04B 11/008* (2013.01); *G04B 19/25353* (2013.01); *G04B 19/25373* (2013.01); *G05G 5/06* (2013.01); *Y10T 74/20636* (2015.01)

(58) Field of Classification Search

CPC ..... G04B 11/008; G04B 11/028; G04B 19/25373; G04B 19/25353; G05G 5/06; Y10T 74/20636

See application file for complete search history.

(56) References Cited

U.S. PATENT DOCUMENTS

| | | | | |
|---|---|---|---|---|
| 3,609,954 A | | 10/1971 | Hougendobler | |
| 3,626,688 A | | 12/1971 | Bullat | |
| 3,736,743 A | * | 6/1973 | Koike | G04B 17/045 368/168 |
| 3,848,400 A | * | 11/1974 | Fluck | G04B 19/25 368/193 |

(Continued)

FOREIGN PATENT DOCUMENTS

| | | |
|---|---|---|
| DE | 6912966 | 7/1969 |
| EP | 0 360 963 A1 | 4/1990 |

(Continued)

OTHER PUBLICATIONS

Machine translation of DE6912166, retrieved from the internet May 30, 2015.*

(Continued)

*Primary Examiner* — Vit W Miska

(74) *Attorney, Agent, or Firm* — Westerman, Hattori, Daniels & Adrian, LLP

(57) ABSTRACT

Spring (30) for clock mechanism, the spring comprising a body (31) extending between a first end (32) of the spring and a second end (33) of the spring, the spring being intended to be mechanically connected to a housing at each of the first and second ends, the spring comprising, between the first and the second end, at least one member (37) intended to act by contact on an element of the clock mechanism.

21 Claims, 4 Drawing Sheets

(56) References Cited

U.S. PATENT DOCUMENTS

| | | | | |
|---|---|---|---|---|
| 3,911,667 | A | 10/1975 | Komiyama | |
| 3,983,691 | A * | 10/1976 | Schaller | G04B 27/02 368/31 |
| 4,634,287 | A | 1/1987 | Vuilleumier et al. | |
| 4,910,721 | A | 3/1990 | Hayakawa et al. | |
| 4,945,521 | A | 7/1990 | Klaus | |
| 4,998,230 | A * | 3/1991 | Fini | G04B 19/223 368/27 |
| 5,172,351 | A | 12/1992 | Corlet | |
| 6,636,457 | B2 | 10/2003 | Lin | |
| 7,158,448 | B1 | 1/2007 | Gabathuler et al. | |
| 7,643,379 | B2 | 1/2010 | Villar et al. | |
| 2007/0019507 | A1 | 1/2007 | Gabathuler et al. | |
| 2009/0016169 | A1 | 1/2009 | Villar et al. | |
| 2011/0194382 | A1 | 8/2011 | Fujiwara et al. | |
| 2011/0286311 | A1 | 11/2011 | Ono | |
| 2012/0057434 | A1 | 3/2012 | Rudaz | |
| 2012/0127837 | A1 | 5/2012 | Bode et al. | |
| 2012/0195169 | A1 | 8/2012 | Courvoisier | |

FOREIGN PATENT DOCUMENTS

| | | | |
|---|---|---|---|
| EP | 1586961 | A2 | 10/2005 |
| EP | 1746470 | A1 | 1/2007 |
| EP | 2015146 | A1 | 1/2009 |
| EP | 2 309 346 | A1 | 4/2011 |
| FR | 2043711 | A1 | 2/1971 |
| FR | 2080602 | A1 | 11/1971 |

OTHER PUBLICATIONS

Notice of Allowance dated Sep. 17, 2015 in co-pending U.S. Appl. No. 14/368,707 (12 pages).

International Search Report dated Jul. 25, 2013 issued in corresponding application No. PCT/EP2012/076911.

International Search Report dated Jul. 25, 2013 issued in application No. PCT/EP2012/076914, counterpart of co-pending U.S. Appl. No. 14/368,707 (2 pages).

Office Action dated Mar. 11, 2015 in co-pending U.S. Appl. No. 14/368,707 (13 pages).

Office Action dated Feb. 12, 2016 in co-pending U.S. Appl. No. 14/368,707 (7 pages).

* cited by examiner

SPRING FOR CLOCK MOVEMENT

The invention relates to a spring for a horological mechanism or a spring of a horological mechanism. The invention also relates to a horological mechanism, especially a calendar mechanism, a correction mechanism or a detent mechanism, comprising such a spring. The invention also relates to a horological movement comprising such a spring or such a mechanism.

Horological mechanisms are generally provided with springs, levers and cams, which are intended to interact in order to perform various functions of a horological movement. Energy, taken from the driving device or even supplied by the wearer of the wristwatch, is thus accumulated and released by the springs in such a way as to assure the functions, all within a limited volume. Horological designs are thus frequently constrained by their physical size, which leads to spring geometries in which the mechanical stresses are very high in relation to the forces to be provided. In certain circumstances, it is possible to make use of "wire" springs. However, the dimensional tolerances are particularly tight, and the bending tolerances are very difficult to guarantee, which makes the industrial and repeatable production of such springs problematical.

Already familiar from document EP2309346 is a trailing calendar mechanism, of which the date can be corrected rapidly by means of a detent device constituted by a spring lever provided to interact with a cam. It is stipulated that this spring lever is mounted integrally with a driving gear for an axis 28 and via a pivot 30. The latter exhibits two distinct pivoting points arranged below the lever. The geometrical configuration of this spring is such that it requires the spring to be compressed strongly in order to enable it to deliver a mechanical action of given intensity.

Already familiar from document EP0360963A1 is a mechanism with two time zones. The adjustment of a second time zone relative to the reference time zone is likewise performed by means of a detent device constituted by a spring lever provided in order to interact with a cam. This spring lever is mounted pivotably about two distinct axes arranged below the lever. The geometrical configuration of this spring is such that it requires the spring to be compressed strongly in order to enable it to deliver a mechanical action of given intensity.

With these different springs, it can be appreciated that strong constraints in respect of their physical size exist if it is wished to limit the mechanical stresses in the spring when the latter is acted upon, in particular when it is provided specifically for the purpose of storing mechanical energy.

The object of the invention is to make available a spring for a horological mechanism which permits the aforementioned disadvantages to be overcome and the springs that are familiar from the prior art to be improved. In particular, the invention proposes a spring permitting the mechanical stresses to which it is subjected to be minimized when it is acted upon, while at the same time being housed within a given space.

According to the invention, the spring for a horological mechanism comprises a body extending between a first end of the spring and a second end of the spring. The spring is intended to be connected mechanically to a frame at each of the first and second ends. The spring comprises, between the first and the second end, at least one member intended to act by contact on an element of the horological mechanism. The spring comprises a first element for mechanical connection to the frame at the first end and a second element for mechanical connection to the frame at the second end. The spring is intended to be connected to the frame via a pivoting connection at the first end, and the spring is intended to be connected to the frame via a pivoting connection at the second end. In order to do this, the first mechanical connection element and the second mechanical connection element are pivoting connection elements.

Different embodiments of the spring are defined as follows:

- The spring as above, wherein the distance between the first and the second ends, once the spring has been mounted on the frame, is less than 5 mm, or less than 2 mm, or less than 1 mm.
- The spring as above, wherein the distance between the first and the second ends, once the spring has been mounted on the frame, is less than 8 times the thickness of the first and second ends of the spring, and more preferably is less than 6 times the thickness of the first and second ends of the spring.
- The spring as above, wherein the body comprises a deformable zone extending in a curve.
- The spring as above, wherein the curve is circular or substantially circular, and/or in that the curve extends at an angle ($\alpha$) greater than 200°, or greater than 220°, when viewed from the center of gravity of the body of the spring, and/or in that half-lines originating from the center of gravity of the body of the spring and passing respectively through the first and second ends form an angle ($\beta$) of less than 50°, or less than 40°.
- The spring as above, wherein the curve is a plane curve.
- The spring as above, wherein the member comprises a finger protruding on the body of the spring.
- The spring as above, wherein it is made of spring steel or silicon or nickel or nickel-phosphorus or an amorphous metal alloy.
- The spring as above, wherein the body has a generally annular form exhibiting an opening.
- The spring as above, wherein the member is intended to release energy, especially in the form of mechanical work, to the element of the horological mechanism.

A horological mechanism, especially a calendar mechanism, a correction mechanism or a detent mechanism, is defined by comprising a spring as above.

Different embodiments of the mechanism are defined as follows:

- The horological mechanism as above, wherein it comprises a frame and an element that is mobile relative to the frame, and in that the surface of the spring acts by contact on the mobile element.
- The horological mechanism as above, wherein, in the normal functioning of the mechanism, the mobile element is displaced by at least 10° relative to the frame, or by at least 15°, or by at least 20°, or by at least 30°, and/or the finger is displaced by at least 5°, or by at least 10°, about the axis of a connection element at the time of passage from a configuration of maximum stress in the spring to a configuration of minimum stress in the spring.

A horological movement is defined by comprising a horological mechanism as above or a spring as above.

A timepiece, especially a watch, is defined by comprising a horological movement as above or a horological mechanism as above, or a spring as above.

The accompanying drawings depict, by way of example, four variant embodiments of a horological spring according to the invention.

Figure 1:
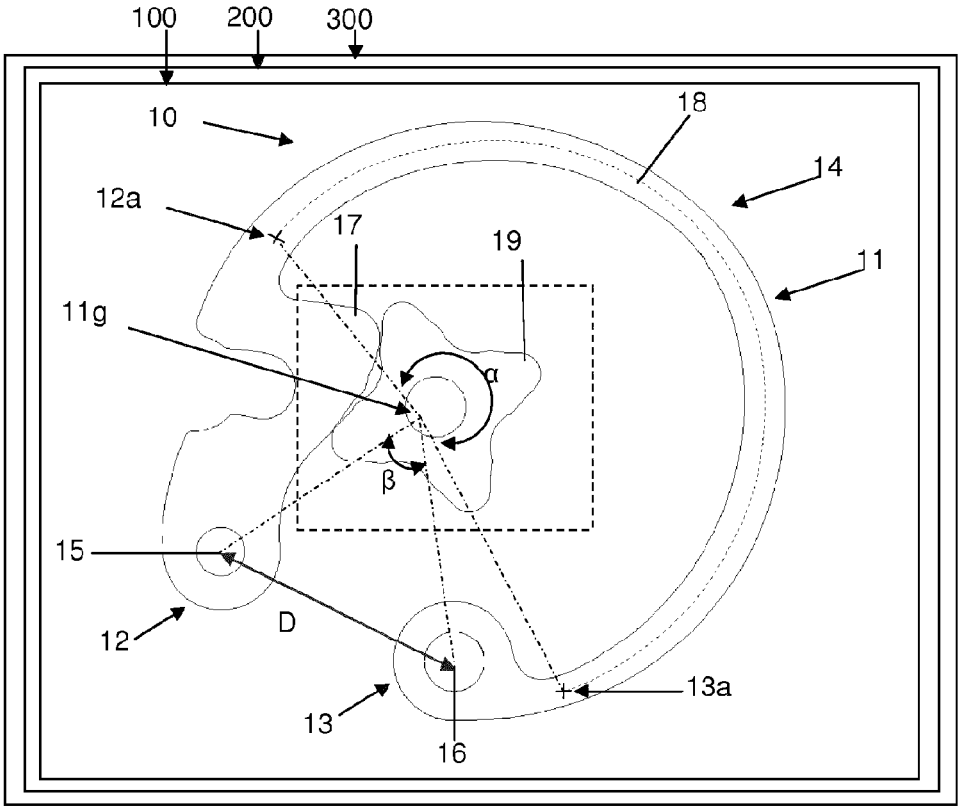
FIG. 1 is a schematic view of a timepiece comprising a first variant of a horological spring according to the invention possessing a first configuration.

A timepiece 300 according to the invention is described below with reference to FIG. 1. The timepiece is a watch, for example, especially a wristwatch. The timepiece comprises a horological movement 200, especially a horological movement of the mechanical type. The horological movement comprises a mechanism 100, especially a mechanism including an element 19 and a spring 10.

A first variant of the spring 10 for a horological mechanism or a spring of a horological mechanism is described below with reference to FIGS. 1 and 2. The spring is used, for example, in a horological mechanism of the type comprising a device for the rapid correction of a time display. The spring 10 is provided, for example, in order to interact by action by contact on an element 19 of the horological mechanism in order to generate a detent during the correction such as to permit the adjustment of a time display via a predefined stepping angle. The spring is intended to be mounted on a frame.

The spring 10 comprises a body 11 which extends between a first end 12 of the spring and a second end 13 of the spring. The body 11 of the spring 10 comprises a zone 14 of substantially rectangular cross section that is highly deformable under an action of a given intensity. This zone is situated between the points 12*a* and 13*a* of the respective ends 12 and 13, beyond which the cross section of the body 11 of the spring 10 may vary significantly. The zone 14 does not generally comprise the elements 15 and 16 for connecting the respective ends 12 and 13. The curve 18, along which the zone 14 of the body 11 extends between the points 12*a* and 13*a*, is preferably a circular or substantially circular curve, situated in the interior of which is the center of gravity 11*g* of the body 11 of the spring. This curve is generally concave when viewed from the center of gravity 11*g* of the body 11 of the spring. However, the curve may exhibit locally one or a plurality of convexities. The curve 18 is likewise preferably a plane curve. The body of the spring or the spring thus extends in a plane. Alternatively, the first end of the spring can be oriented in a first plane, and the second end can be oriented in a second plane. The first plane and the second plane are not necessarily parallel. Preferably, the axis of a first connecting element is perpendicular to the first plane, and the axis of a second connecting element is perpendicular to the second plane. The first connecting element provided on the spring interacts with another connecting element on the frame in such a way as to constitute a pivoting connection between the spring and the frame. Similarly, the second connecting element provided on the spring interacts with another connecting element on the frame in such a way as to constitute a pivoting connection between the spring and the frame.

The spring comprises, between the first 12 and the second end 13, a member 17 intended to act by contact on the element 19 of the horological mechanism, which is by preference mobile in relation to the frame. The element 19 is a star 19, for example, that is capable of rotating about its center, and the member 17 is a finger 17, for example, protruding on the body 11 of the spring. This finger comprises a contact surface intended to act by contact on the star 19.

The member 17 is oriented towards the interior of the curve of the body of the spring when viewed from the center of gravity of the body of the spring.

The spring is intended to be connected mechanically to a frame at each of the first and second ends respectively by first and second pivoting connections. More specifically, the spring comprises a first pivoting element 15 for connecting to the frame at the first end 12 and a second pivoting element 16 for connecting to the frame at the second end 13. The first connecting element preferably comprises a bore 15 or a bore portion intended to receive an axis mounted on the frame. Likewise, the second connecting element preferably comprises a bore or a bore portion 16 intended to receive an axis mounted on the frame. In the event of a connecting element comprising a bore portion, the spring can be a sliding fit on an axis that is fixed to the frame.

In this first variant, the distance D between the first and the second ends, in particular between the axis of the first connecting element and the axis of the second connecting element, is in the order of 2 mm, and the thickness E measured at the ends 12 and 13 is in the order of 0.2 mm. The thickness E of the spring is measured perpendicularly to the plane in FIGS. 1 and 2. The angle β formed by the two half-lines originating from the center of gravity 11*g* of the body 11 of the spring and passing through the axis of the first connecting element 15 and the axis of the second connecting element 16 is in the order of 60°.

Figure 2:
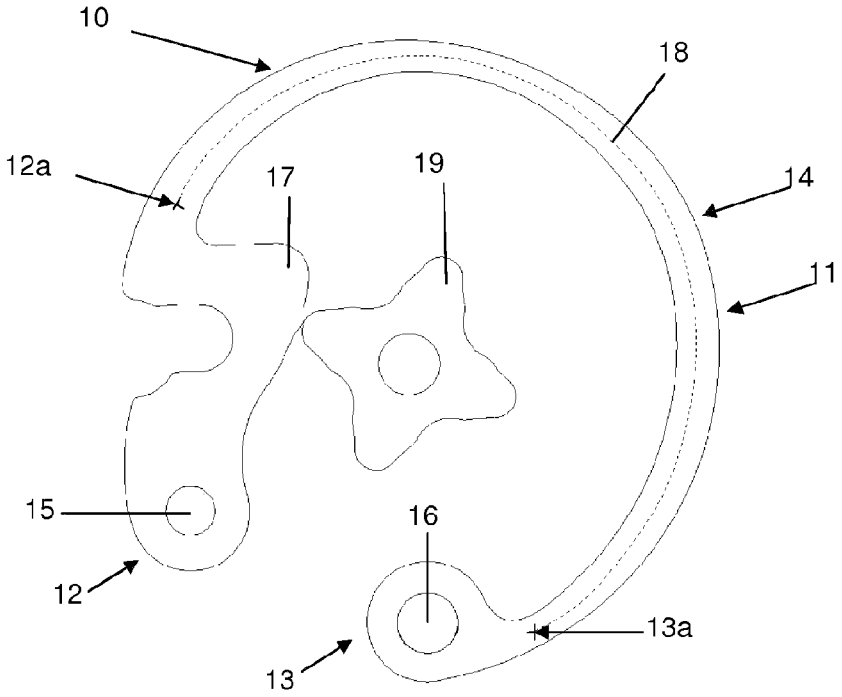
FIG. 2 is a view of the first variant of the horological spring according to the invention possessing a second configuration.

On rotating the star from the configuration depicted in FIG. 1 to that depicted in FIG. 2, the star acts by contact on the finger 17 of the spring. This results in an elastic deformation of the spring which stores mechanical energy. It also results in rotations at the ends of the spring. Conversely, on continuing to rotate the star from the configuration depicted in FIG. 2 to that depicted in FIG. 1, the finger 17 acts by contact on the star 19. The spring then releases the energy that it had stored, and this results in rotations at the ends of the spring. To put it another way, the spring is intended to store mechanical energy as a result of its deformation under the influence of a driving device or the wearer and to release this energy or a part of this energy to the element 19, in particular by the contact of the member 17 on the element 19. This release of energy makes it possible to drive or activate or actuate the element or a mechanism. The released energy takes the form of mechanical work acting on or placing in movement or displacing the element 19.

The spring can be mounted prestressed on the frame in a configuration in which it does not act on the element 19, or in a configuration in which the intensity of its contact action on the element 19 is minimal.

As a consequence of the two pivoting connections of the spring, the angular rigidity of the spring is optimized in such a way that the spring produces a range of torque or force that is adapted, for example, to the detent function as described previously, and that the mechanical stresses within it are lower than the maximum admissible stressing of the constituent material of the spring. To put it another way, the two pivoting connections of the spring make it possible to minimize the mechanical stresses to which the spring is subjected when it is acted upon.

Such a spring is particularly advantageous with respect to its small installation space requirement.

Furthermore, such a spring is also particularly suitable for industrial production. More particularly, as a consequence of the two pivoting connections of the spring, the angular rigidity of the spring is optimized in such a way that the zone 14 of the body 11 of the spring 10 exhibits a cross section that is suitable for an industrial manufacturing process.

In order to reduce the mechanical stresses within the spring and/or to optimize the forces or the torques produced by the spring, the distance D between the first and the second ends, in particular between the axis of the first connecting element and the axis of the second connecting element, may be minimized. The distance D may, in fact, be reduced to the minimum distance required between the axis of the first connecting element and the axis of the second connecting element with respect to the thickness E of the spring and the residual walls of material measured at its two ends.

Figure 3:
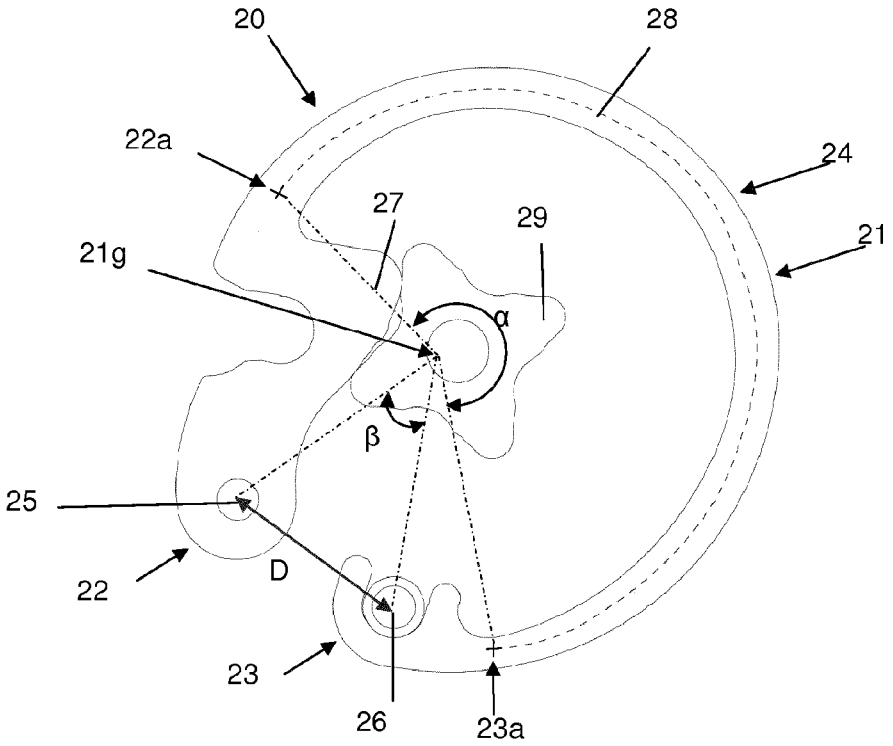
FIG. 3 is a view of a second variant of a horological spring according to the invention possessing a first configuration.
Figure 4:
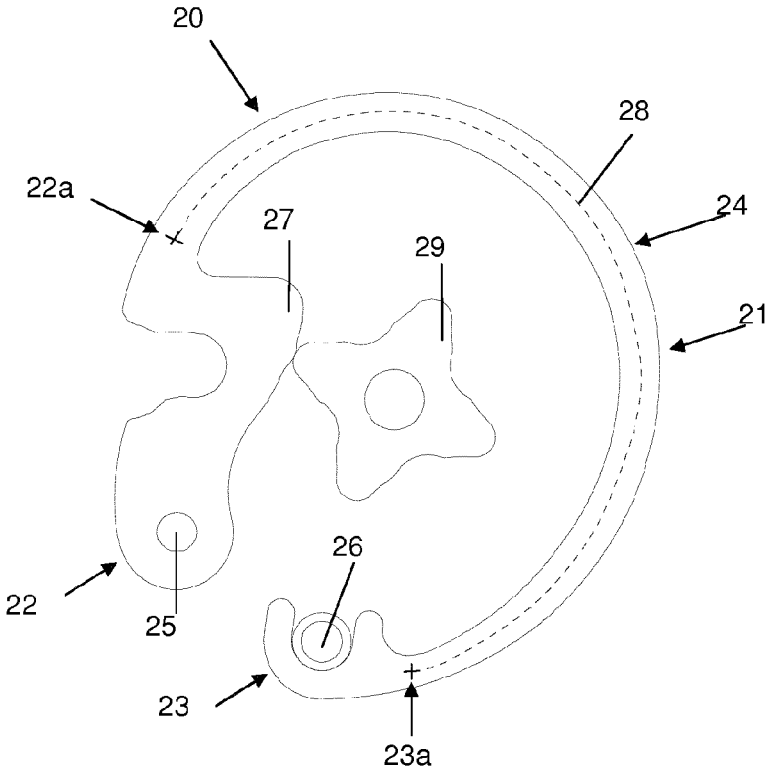
FIG. 4 is a view of the second variant of the horological spring according to the invention possessing a second configuration.

FIGS. 3 and 4 illustrate a second variant of a spring 20 which may, for example, perform the same functions as the spring 10 described previously.

The spring 20 is likewise used in a device for the rapid correction of a time display. The spring 20 is provided, for example, in order to interact by action by contact on a star 29 of a horological mechanism, identical to the star 19, in order to generate a detent during the correction such as to permit the adjustment of a time display via a predefined stepping angle.

On rotating the star 29 from the configuration depicted in FIG. 3 to that depicted in FIG. 4, the star acts by contact on the finger 27 of the spring. This results in an elastic deformation of the spring which stores mechanical energy. It also results in rotations at the ends of the spring. Conversely, on continuing to rotate the star from the configuration depicted in FIG. 4 to that depicted in FIG. 3, the finger 27 acts by contact on the star 29. The spring then releases the energy that it had stored, and this results in rotations at the ends of the spring.

In this second variant embodiment, once the spring 20 has been mounted on the frame, the distance D between the first and second ends, especially between the axis of the first connecting element and the axis of the second connecting element is in the order of 1 mm, and the thickness E measured at the ends 22 and 23 is in the order of 0.2 mm within the spring 20 illustrated by FIGS. 3 and 4. The thickness E of the spring is measured perpendicularly to the plane of FIGS. 3 and 4. The curve 28, viewed from the center of gravity 21*g* of the body 21 of the spring, extends on an arc $\alpha$ in the order of 210° within the spring 20 illustrated in the configuration depicted in FIG. 3. The angle $\beta$ formed by the two half-lines originating from the center of gravity 21*g* of the body 21 of the spring and passing respectively via the ends 22 and 23, especially via the axis of the first connecting element 25 and the axis of the second connecting element 26, is in the order of 45° within the spring 10 illustrated in the configuration depicted in FIG. 3.

Figure 5:
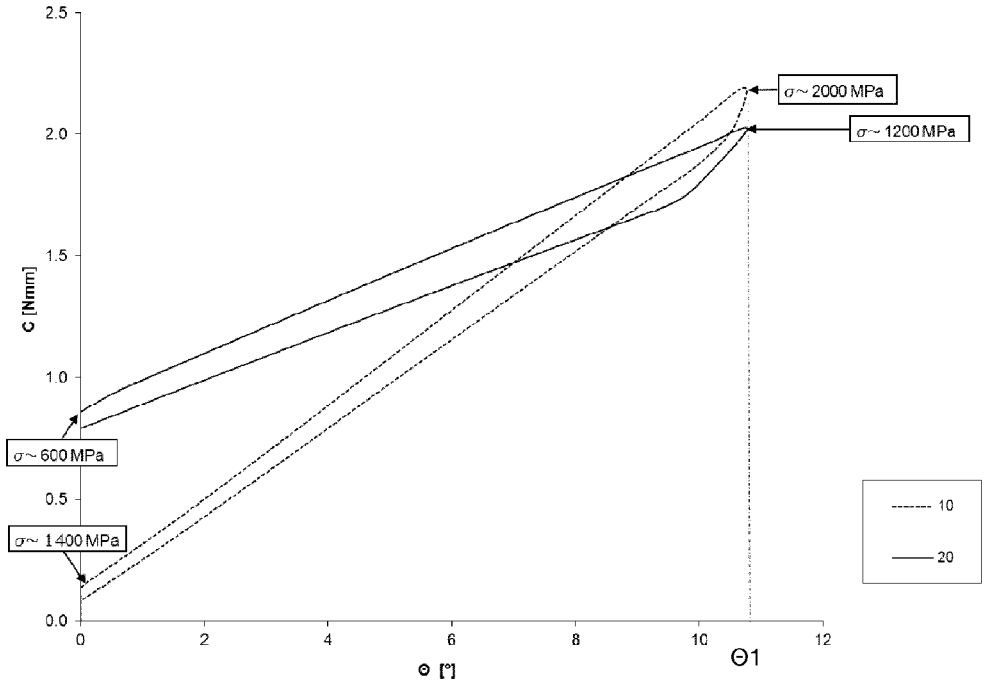
FIG. 5 is a graph illustrating two torque (C)/angular displacement (θ) characteristics of the first and second variants of the spring according to the invention, whereby the same coefficient of friction exists between each spring and the components on which it is mounted. The maximum stresses within these springs, for a given material, are likewise plotted for each of their extreme positions.

Simulations have been carried out permitting the torque C/angular displacement $\theta$ characteristic of the spring 10 and the spring 20 to be established, and permitting the stresses $\sigma$ within these springs to be evaluated. Results illustrated in FIG. 5 show the influence of the distance D on the torques and mechanical stresses of the springs 10 and 20. For a given coefficient of friction, and for a given material such as a spring steel, a maximum stress in the order of 2000 MPa can be calculated for the spring 10 when the latter is in contact with the peak of a star tooth after having pivoted through an angle $\theta$1. In the same configuration, a maximum stress in the order of 1200 MPa can be calculated for the spring 20, that is to say a reduction in the order of 40% in relation to that obtained for the spring 10. Furthermore, it can be calculated that the spring 20, depending on its angular displacement, permits the delivery of a torque that is greater than or substantially equal to that produced by the spring 10.

It can therefore be concluded that the minimization of the distance between the first and the second pivoting connections of the spring permits the angular rigidity of the spring to be reduced in such a way that the mechanical stresses within it are minimized.

Preferably, during normal operation of the mechanism, the element 19, 29 is displaced by at least 10°, or by at least 15°, or by at least 20°, or by at least 30° relative to the frame at the time of passage from a configuration of maximum stress in the spring to a configuration of minimum stress in the spring. This displacement takes place under the effect of the release of the mechanical energy stored in the spring, especially in the form of mechanical work. At the time of the said displacement, the finger 17, 27 can be displaced by at least 5°, or by at least 10°, about the axis of a connection element 25.

A third variant embodiment of a spring 30 for a horological mechanism is described below with reference to FIGS. 6 and 7. The spring 30 is used, for example, in a calendar device illustrated in FIG. 6. The spring 30 is provided, for example, in order to interact by action by contact on an element 1 of the calendar device in order to generate a drive for a disk for displaying the days (not illustrated in FIG. 6). This can be used advantageously in place of a conventional drive finger associated with an additional spring with the resulting risk of overcrowding the horological mechanism to a significant degree. Other than in its application, the third variant of the spring differs from the first variant solely in respect of the elements that are described below.

The spring 30 comprises a body 31 which extends between a first end 32 of the spring and a second end 33 of the spring. The spring comprises, between the first end and the second end, a member 37, in particular a driving finger 37, which is intended to act by contact on the element 1 of the horological mechanism. The body 31 of the spring exhibits one zone 34 of substantially rectangular cross section that is highly deformable under an action of a given intensity. This zone is situated between the points 32*a* and 33*a* of the respective ends 32 and 33, beyond which the cross section of the body 31 of the spring 30 can vary substantially. The zone 34 does not, as a rule, comprise the elements 35 and 36 for connecting the respective ends 32 and 33. The curve 38, along which the zone 34 of the body 31 extends between the points 32*a* and 33*a*, is preferably a circular or substantially circular curve, in the interior of which is situated the center of gravity 31*g* of the body 31 of the spring. This curve is generally concave when viewed from the center of gravity 31*g* of the body 31 of the spring. This curve is generally concave when viewed from the center of gravity 31*g* of the body 31 of the spring. However, the curve may exhibit locally one or a plurality of convexities. The curve 38 is likewise preferably a plane curve. The body of the spring or the spring thus extends in a plane. Alternatively, the first end of the spring can be oriented in a first plane, and the second end can be oriented in a second plane. The first plane and the second plane are not necessarily parallel. Preferably, the axis of the first connecting element is perpendicular to the first plane, and the axis of the second connecting element is perpendicular to the second plane.

The member 37 is oriented towards the exterior of the curve of the body of the spring when viewed from the center of gravity of the body of the spring.

The spring is intended to be connected mechanically to a frame at each of the first and second ends respectively by first and second pivoting connections. More specifically, the spring comprises a first pivoting element 35 for connecting to the frame at the first end 32 and a second pivoting element 36 for connecting to the frame at the second end 33. The first connecting element preferably comprises a bore 35 or a bore portion intended to receive an axis mounted on the frame. Likewise, the second connecting element preferably comprises a bore or a bore portion 36 intended to receive an axis mounted on the frame. In the event of a connecting element comprising a bore portion, the spring can be a sliding fit on an axis that is fixed to the frame.

Figure 7:
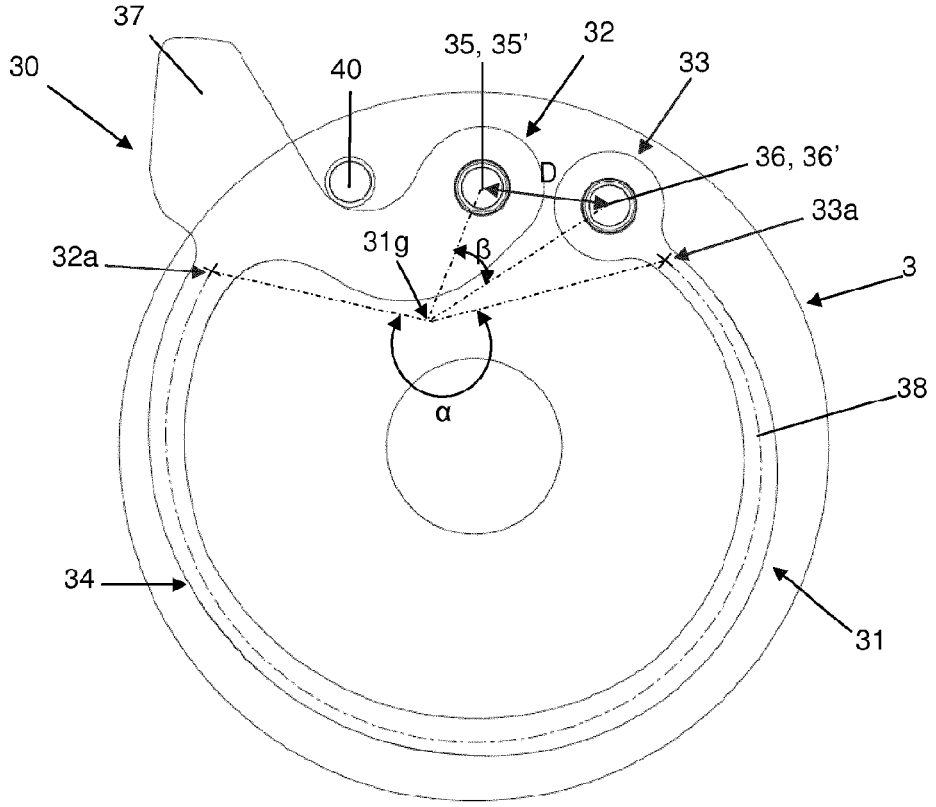
FIG. 7 is a view of the third variant of a horological spring according to the invention.

FIG. 7 illustrates a spring 30, in a given configuration, which exhibits the characteristics referred to above.

Once the spring 30 has been mounted on the frame, the distance D between the first and second ends, especially between the axis of the first connecting element 35 and the axis of the second connecting element 36, is minimized and is in the order of 1 mm. The thickness E measured at the ends 32 and 33, and measured perpendicularly to the plane of FIG. 7, is in the order of 0.2 mm. The angle $\alpha$ at which the curve 38 extends is in the order of 215°. The angle $\beta$ formed by the two half-lines originating from the center of gravity 31*g* of the body 31 of the spring and passing via the axis of the first connecting element 35 and the axis of the second connecting element 36 is in the order of 30°.

The frame 3 is constituted, for example, by a wheel 3. Preferably, the element 1 is movable in relation to the frame 3. In the variant illustrated in FIGS. 6 and 7, the element is a day star that is capable of rotating about its center in relation to a structure on which the wheel 3 is similarly mounted so as to be capable of rotating.

Figure 6:
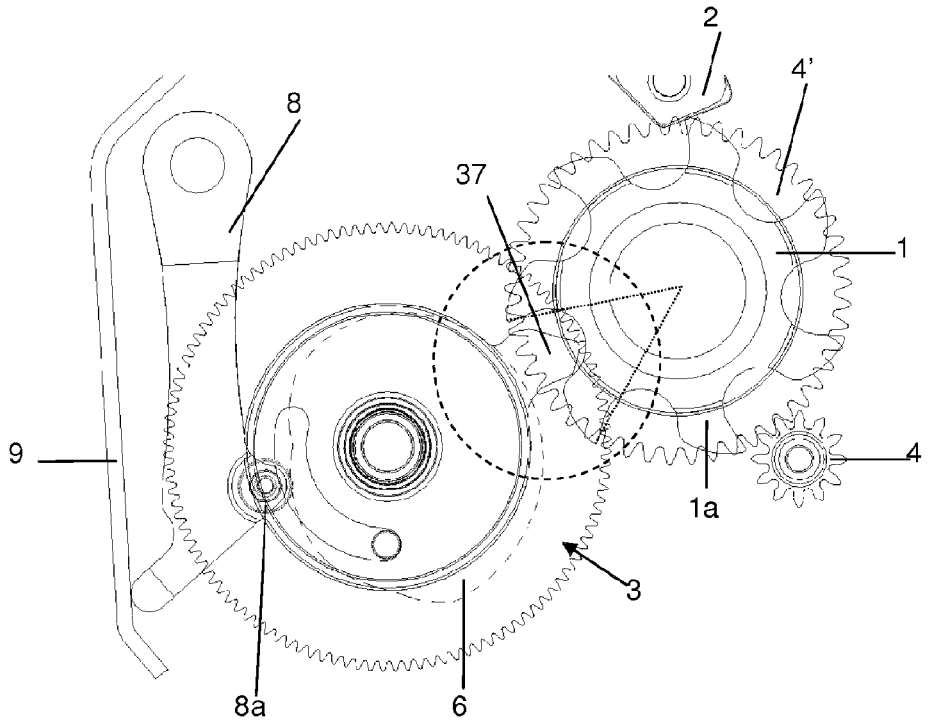
FIG. 6 is a view of a calendar mechanism equipped with a third variant of a horological spring according to the invention.

The star 1 comprises seven teeth 1*a* and carries the disk for displaying the days (not illustrated in FIG. 6). The toothing 1*a* of this star 1 is indexed in an angular manner by means of a nose 2 and is driven in an instantaneous manner, every 24 hours at midnight, by means of the driving wheel 3. This device is accompanied by a rapid correction mechanism constituted by a corrector 4 and a correction wheel 4' that is integral with the star 1. When the mechanism is activated, the corrector 4 is positioned in such a way that its toothing is able to engage in a single direction with the toothing of the correction wheel 4'. The day display is thus corrected solely in the chronological direction. FIG. 6 illustrates this calendar mechanism in a configuration in which the driving finger 37 is positioned and maintained within the toothing 1*a* by means of a rocker 8, of which a cam follower 8*a* is applied against a stop curve 6*c* of a cam 6. More specifically, FIG. 6 shows the finger 37 in a position in which it needs to be able to retract for the totality of a stepping angle of the star 1, or approximately 50°, during a rapid correction of the day display. The retractable finger must thus be capable of permitting rotation about the first mechanical connecting element 35 over a large angular extent in the order of 50°, while exhibiting stresses within it that are lower than those that are admissible for the material by which it is constituted.

In operation, the spring 30 presses the finger 37 against a pin 40 so that the finger 37 behaves like a rigid finger in order to ensure the jump by the day display. In order to do this, the spring is lightly pre-wound during assembly. In FIG. 7, the spring is illustrated after assembly, in particular by sliding the second end into place on an axis 36'. The torque produced by the spring also permits the finger 37 to stop the day star after the date jump, and in so doing avoids all risk of a double jump. The finger 37 pivots with a value in the order of 50° about the pivot about the pin 35'. The other pivot, about the pin 39, in turn makes it possible to generate such a displacement of the finger 37, while at the same time restricting the deformation of the spring. The stresses that are experienced during the complete retraction of the finger 37 thus remain lower than the elastic limit of the material constituting the spring.

As a consequence of the two pivoting connections of the spring 30, the angular rigidity of the spring is optimized in such a way that the displacement of the finger 37 is maximized. To put it another way, the two pivoting connections of the spring make it possible to minimize the mechanical stresses to which the spring is subjected when it is acted upon. These stresses are minimized to the same extent to which the distance between the two pivoting connections for the spring is minimized.

The member 37 is preferably positioned close to one of the two ends 32 and 33 of the spring in such a way as to define a continuous deformable zone 34, the extent of which is maximized between the points 32*a* and 32*b* of the spring. If, however, for reasons of architecture, the position of the element on which the spring acts and the position of at least one of the two ends are fixed, it may be advantageous to interrupt the deformable zone of the spring by the rigid member that is capable of coming into contact with the element on which the spring acts. Although less favorable in terms of angular rigidity, since the extent of the deformable zone of the spring is reduced, this configuration may be entirely satisfactory in order to minimize the stresses within the spring in a given configuration.

Figure 8:
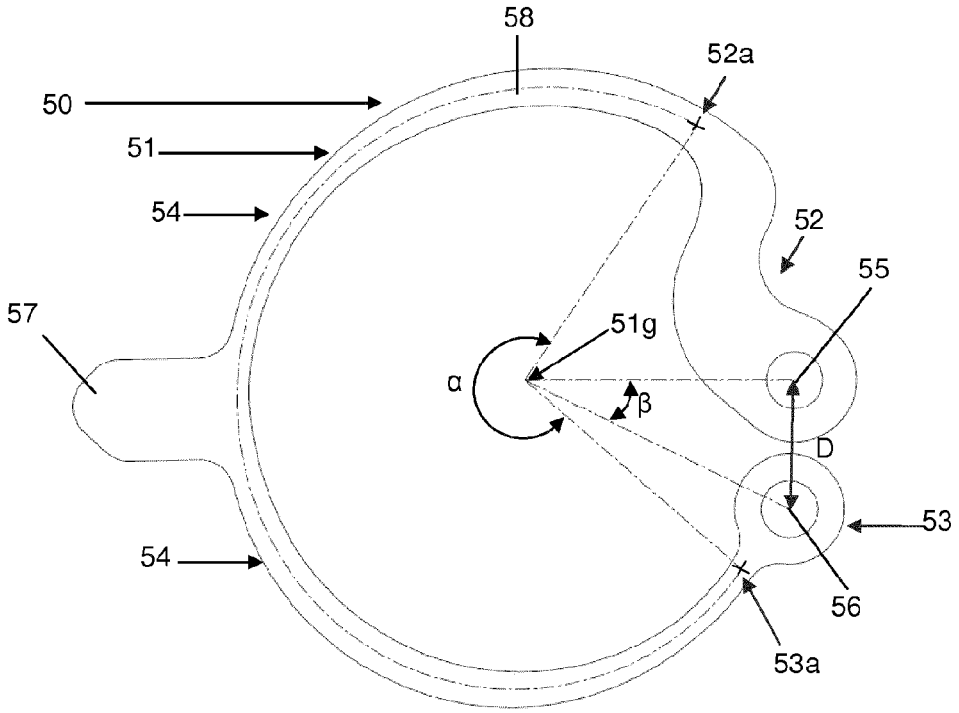
FIG. 8 is a view of a fourth variant of a horological spring according to the invention.

FIG. 8 illustrates a fourth variant embodiment of a spring 50 which may, for example, exhibit the same functions as the spring 30 described previously.

The spring 50 comprises, between the first end and the second end, a member 57 intended to act by contact on an element of a horological mechanism. The body 51 of the spring exhibits a zone 54 of substantially rectangular cross section that is highly deformable under an action of a given intensity. This zone 54 is constituted by two parts that are delimited by the member 57. This zone is situated between the points 52*a* and 53*a* of the respective ends 52 and 53, beyond which the cross section of the body 51 of the spring 50 can vary substantially. The curve 58 along which the zone 54 of the body 51 extends between the points 52*a* and 53*a* is preferably a circular or substantially circular curve 58, situated in the interior of which is the center of gravity 51*g* of the body 51 of the spring. This curve is generally concave when viewed from the center of gravity 51*g* of the body 51 of the spring.

FIG. 8 illustrates a spring 50, in a given configuration, which exhibits the characteristics referred to below.

Once the spring 50 has been mounted on the frame, the distance D between the first and second ends, especially between the axis of the first connecting element 65 and the axis of the second connecting element 66, is in the order of 1 mm. The thickness E measured at the ends 62 and 63, and measured perpendicularly to the plane of FIG. 8, is in the order of 0.2 mm. The angle $\alpha$ at which the curve 68 extends is in the order of 265°. The angle $\beta$ formed by the two half-lines originating from the center of gravity 61*g* of the body 61 of the spring and passing through the axis of the first connecting element 65 and the axis of the second connecting element 66 is in the order of 25°.

Irrespective of which variant embodiment is considered, the proximity of the centers of the mechanical connecting elements allows low angular rigidity and permits a large angular stroke to be performed without exceeding the permissible stress.

Once the spring has been mounted on the frame, the distance between the first and second ends, especially between the axis of the first connecting element and the axis of the second connecting element, is preferably less than 5 mm, or less than 2 mm, or less than 1 mm and/or is less than 8 times the thickness of the ends of the spring, or less than 6 times the thickness of the ends of the spring.

Irrespective of which variant embodiment is considered, the spring comprises, between the first end and the second end, at least one member intended to act by contact on an element of the horological mechanism.

Irrespective of which variant embodiment is considered, the spring has a generally annular form exhibiting an opening.

Irrespective of which variant embodiment is considered, the curve 18, 28, 38, 58 is preferably a plane curve. The body of the spring or the spring thus extends along a plane. Alternatively, the first end of the spring can be oriented along a first plane, and the second end can be oriented along a second plane. The first plane and the second plane are not necessarily parallel. Preferably, the axis of the first connecting element is perpendicular to the first plane, and the axis of the second connecting element is perpendicular to the second plane.

Irrespective of which variant embodiment is considered, the curve 18, 28, 38, 58 along which the zone 14, 24, 34, 54 of the body 11, 21, 31, 51 extends between the points 12*a*, 22*a*, 32*a*, 52*a* and 13*a*, 23*a*, 33*a*, 53*a* is preferably a circular or substantially circular curve, situated in the interior of which is the center of gravity 11*g*, 31*g*, 51*g* of the body 11, 31, 51 of the spring. This curve is generally concave when viewed from the center of gravity 11*g*, 21*g*, 31*g*, 51*g* of the body 11, 21, 31, 51 of the spring. However, the curve may exhibit locally one or a plurality of convexities. This curve, when viewed from the center of gravity of the body of the spring, preferably extends in an arc having an angular range $\alpha$ greater than 200°, or 220°. Alternatively, the centers of gravity 11*g*, 21*g*, 31*g*, 51*g* of the bodies of the springs 10, 20, 30, 50 may be the centers of gravity of the curves passing through the centers of the straight cross sections of the springs and linking the axes of the connecting elements.

Irrespective of which variant embodiment is considered, the spring can be made of different materials. It can be made, in particular, of spring steel, of silicon, of nickel, of nickel-phosphorus or of an amorphous metal alloy. The spring can be made, for example, by a mechanical process such as stamping or wire cutting. The spring can also be made by stereolithography, by a LIGA process, by a DRIE etching process, or even by a laser etching process. These production processes make it possible, in particular, to produce thin thicknesses of material at the connecting elements, which permits the axes of the mechanical connection elements to be positioned as close together as possible.

For reasons of architecture, it is possible for the member that is intended to act by contact on an element of the horological mechanism to exhibit a different thickness from that of the other parts of the spring. The spring according to the invention can thus exhibit zones having different thicknesses.

Irrespective of which variant embodiment is considered, because of its low angular rigidity, the monobloc spring makes it possible to maximize the energy accumulated during its loading, while at the same time limiting the stresses within it. The spring makes it possible to provide the forces that are necessary in order to be able to perform various horological functions in a given volume. In order to do so, the monobloc spring exhibits two distinct and close pivots.

This spring thus makes it possible:

to maximize the active length of the spring;

to minimize the deformation of the spring in the course of its function;

to minimize the angular stiffness of the spring;

to minimize the stresses within the material;

to prestress the spring in an optimal manner.

The distance between the axes of the connecting elements depends directly on the minimum material thicknesses that can be achieved by the production process.

Of course, the use of such a spring according to the invention is not restricted to the applications described previously. It is conceivable to integrate this spring within a chronograph mechanism or within a countdown mechanism, for example.

Finally, the invention also relates to a horological movement or to a timepiece, especially to a watch, comprising a horological mechanism as described previously or a spring as described previously.

Throughout this document, the expression "spring" has been used to designate a monobloc element comprising a first part that is highly deformable under an action of a given intensity and a second part, especially at the member, which is weakly deformable or non-deformable under this same action. This has been done by analogy with other uses of the expression "spring". In particular, the expression "spring" is also used in a habitual manner to designate a helicoidal spring that is subjected to tensile loading and is terminated by a hook at each of these ends. It is clear, however, that such a helicoidal spring comprises a first part (configured as a helix) that is highly deformable under an action of a given intensity, and a second part (the hooks) that is weakly deformable, or non-deformable, under this same action.

Throughout this document, the expression "body" or "spring body" designates the spring itself, that is to say the material forming the spring.

The invention claimed is:

1. A spring for a horological mechanism, the spring comprising:

a body extending between a first end of the spring and a second end of the spring, the spring being intended to be connected mechanically to a frame at each of the first and second ends, between the first and the second end, at least one member intended to act by contact on an element of the horological mechanism, a first element for mechanical connection to the frame at the first end and a second element for mechanical connection to the frame at the second end, wherein the spring is intended to be connected via a pivot connection to the frame at the first end and the spring is intended to be connected via a pivot connection to the frame at the second end, wherein the distance between the first and the second ends, once the spring has been mounted on the frame, is less than 8 times the thickness of the first and second ends of the spring.

2. The spring as claimed in claim 1, wherein the distance between the first and the second ends, once the spring has been mounted on the frame, is less than 5 mm.

3. The spring as claimed in claim 1, wherein the body comprises a deformable zone extending in a curve.

4. The spring as claimed in claim 1, wherein the curve is circular or substantially circular, and/or the curve extends at an angle greater than 200°, when viewed from the center of gravity of the body of the spring, and/or half-lines originating from the center of gravity of the body of the spring and passing respectively through the first and second ends form an angle of less than 50°.

5. The spring as claimed in claim 3, wherein the curve is a plane curve.

6. The spring as claimed in claim 1, wherein the member comprises a finger protruding on the body of the spring.

7. The spring as claimed in claim 1, which is made of spring steel or silicon or nickel or nickel-phosphorus or an amorphous metal alloy.

8. The spring as claimed in claim 1, wherein the body has a generally annular form exhibiting an opening.

9. The spring as claimed in claim 1, wherein the member is intended to release energy to the element of the horological mechanism.

10. A horological mechanism comprising a spring as claimed in claim 1.

11. The horological mechanism as claimed in claim 10, which comprises a frame and an element that is mobile relative to the frame, and wherein the surface of the spring acts by contact on the mobile element.

12. The horological mechanism as claimed in claim 11, wherein, in the normal functioning of the mechanism, the mobile element is displaced by at least 10° relative to the frame and/or a finger of the spring acting on the mobile element is displaced by at least 5° about the axis of a connection element at the time of passage from a configuration of maximum stress in the spring to a configuration of minimum stress in the spring.

13. A horological movement comprising the horological mechanism as claimed in claim 10.

14. A timepiece comprising the spring as claimed in claim 1.

15. A horological movement comprising the spring as claimed in claim 1.

16. The spring as claimed in claim 1, wherein the distance between the first and the second ends, once the spring has been mounted on the frame, is less than 6 times the thickness of the first and second ends of the spring.

17. The spring as claimed in claim 2, wherein the distance between the first and the second ends, once the spring has been mounted on the frame, is less than 8 times the thickness of the first and second ends of the spring.

18. The spring as claimed in claim 17, wherein the distance between the first and the second ends, once the spring has been mounted on the frame, is less than 6 times the thickness of the first and second ends of the spring.

19. The spring as claimed in claim 2, wherein the body comprises a deformable zone extending in a curve.

20. The spring as claimed in claim 1, wherein each of the first element for mechanical connection to the frame at the first end and the second element for mechanical connection to the frame at the second end is a pivot element.

21. The spring as claimed in claim 1, wherein each of the first element for mechanical connection to the frame at the first end and the second element for mechanical connection to the frame at the second end is a bore or a bore portion.

* * * * *